US005605118A

United States Patent [19]

Sinn et al.

[11] Patent Number: 5,605,118

[45] Date of Patent: Feb. 25, 1997

[54] METHOD AND SYSTEM FOR REHEAT TEMPERATURE CONTROL

[75] Inventors: Brian T. Sinn, Williamsport; Michael G. Alliston, Lewisburgh; Kulwarn S. Parmar; Leonid S. Blokh, both of Williamsport; Song Wu, Montoursville; Brian G. Martin; Matti Rautanen, both of Williamsport, all of Pa.

[73] Assignee: Tampella Power Corporation, Williamsport, Pa.

[21] Appl. No.: 339,831

[22] Filed: Nov. 15, 1994

[51] Int. Cl.[6] ..... F22G 5/00

[52] U.S. Cl. ..... 122/479.1; 122/4 A; 122/448.1; 122/459; 122/460; 122/416; 122/479.2; 122/479.7

[58] Field of Search ..... 122/4 A, 448.1, 122/448.2, 448.4, 459, 460, 466, 479.1, 479.2, 479.7

[56] References Cited

U.S. PATENT DOCUMENTS

| | | | |
|---|---|---|---|
| 1,915,052 | 6/1933 | Detterborn . | |
| 2,602,433 | 7/1952 | Kuppenheimer . | |
| 2,747,373 | 5/1956 | Eggenberger . | |
| 2,804,853 | 9/1957 | Epley | 122/479 |
| 2,852,005 | 9/1958 | Buri . | |
| 3,261,332 | 7/1966 | Schuetzenduebel . | |
| 3,882,680 | 5/1975 | Durrant . | |
| 4,165,717 | 8/1979 | Reh . | |
| 4,318,366 | 3/1982 | Tompkins . | |
| 4,419,940 | 12/1983 | Cosar . | |
| 4,419,965 | 12/1983 | Garcia-Mallol . | |
| 4,453,495 | 6/1984 | Strohmeyer, Jr. . | |
| 4,489,679 | 12/1984 | Holt . | |
| 4,493,186 | 1/1985 | Emsperger . | |
| 4,693,086 | 9/1987 | Hoizumi . | |
| 4,748,940 | 6/1988 | Hönig . | |
| 4,776,301 | 10/1988 | Dziubakowski . | |
| 4,791,889 | 12/1988 | Matsko . | |
| 4,887,431 | 12/1989 | Peet . | |
| 4,920,751 | 5/1990 | Gounder . | |
| 5,038,568 | 8/1991 | Gounder . | |

FOREIGN PATENT DOCUMENTS 2099558 12/1982 United Kingdom .

OTHER PUBLICATIONS

"Steam, its generation and use"; edited by S. C. Stultz et al., Chapter 18, pp. 18–13 to 18–23; Fortieth edition (1992), published by The Babcock & Wilcox Company.

*Primary Examiner*—Henry A. Bennett
*Assistant Examiner*—Siddharth Ohri
*Attorney, Agent, or Firm*—Stephen Donovan

[57] ABSTRACT

A method and system for controlling reheater steam temperature is disclosed. The method can be carried out by selectively adjusting the flow of superheated steam into a superheater positioned between two reheater sections in the convection pass of a carbonaceous fuel boiler system.

15 Claims, 4 Drawing Sheets

FINISHING REHEATER
PRIMARY SUPERHEATER 14
PRIMARY REHEATER 12
ECONOMIZER 38
CYCLONE 40
SECONDARY SUPERHEATER
COMBUSTOR 44
FINISHING SUPERHEATER 42
DRUM 46
SATURATED STEAM
20
60
18
58
62
52
16
32
33
48
50
24
68
28
49
30
22
26
70
72
71
64
54
73
34
66
56

METHOD AND SYSTEM FOR REHEAT TEMPERATURE CONTROL

BACKGROUND

The present invention relates to a method and system for controlling reheater temperature. In particular, the present invention relates to a method and system for controlling the temperature of steam exiting a reheater tube bundle positioned in the convection pass of a carbonaceous fuel boiler system.

A modern steam generator can include a complex configuration of various thermal and hydraulic units for preheating and evaporating water, and for superheating steam. The surfaces of such units are arranged to facilitate: a complete and efficient fuel combustion while minimizing emissions of particulate and gaseous pollutants; steam generation at a desired pressure, temperature and flow rate; and to maximize recovery of the heat produced upon combustion of the fuel.

Reheaters and superheaters are specially designed tube bundles capable of increasing the temperature of saturated steam. Additionally, reheaters and superheaters are designed to obtain specific steam outlet temperatures, while keeping metal temperatures from becoming too elevated, and limiting steam flow pressure losses.

Essentially, a reheater or a superheater is a single-phase heat exchanger comprising tubes through which steam flows, and across which the combustion or flue gas passes on the outside of the tubes, usually in crossflow. Reheater and superheater tube bundles are often made of a steel alloy capable of withstanding high operating temperatures.

The main difference between a reheater and a superheater can be steam pressure. Thus, in a typical steam drum boiler the reheater steam outlet pressure can be about 580 psi, while for the superheater it can be about 2700 psi.

It can be crucial to heat rate and cycle efficiency of a steam generator, such as a carbonaceous fuel boiler-turbine power plant, to regulate and control reheater steam temperature within narrow limits. For example, a change of only about 35° F. to 40° F. in reheat outlet steam temperature can lead to a change of about 1% in heat rate at 1800 psi pressure.

A number of methods for controlling the temperature of the steam exiting a reheater are known. The known methods all have one or more deficiencies or drawbacks, such as being very expensive and/or resulting in excessive reheater pressure loss.

One method to control reheat steam temperature is to use a gas bypass over the reheater. In this method, two separate flue gas passes are provided in the convection pass of the boiler, one for the superheater and one for the reheater. Dampers are located downstream of each flue gas pass to vary the amount of gas flow over each section. The reheater steam temperature is then controlled by varying the amount of flue gas flow through each of the two convection pass sections. This method has the disadvantage that the dampers are located in a higher temperature (500° F. to 700° F.) dust laden flue gas path making them susceptible to erosion and mechanical failure.

Another method of reheater outlet steam temperature control is by use of external heat exchangers. In this method, a portion of the recirculated solids from a fluidized bed is diverted to an externally mounted fluidized bed heat exchanger in which a section of or a complete reheater is located. By varying the amount of solids flow to the externally mounted heat exchanger, the quantity of heat transfer to the reheater and hence the reheater steam temperature can be controlled. Unfortunately, this method can include a high maintenance solids control valve and the reheat tube surface with the externally mounted heat exchanger can require high steam velocities to ensure that metal temperature limits are not exceeded. This can increase the pressure loss across the heat exchanger.

A further method to control reheat steam temperature is by water spray, also called direct contact attemperation, by which a cooling water spray is added to the fluid entering the reheater. This method can have a negative effect on cycle efficiency. Another method is to use excess air supplied to the boiler for reheater steam temperature control. This method can have a negative effect on boiler efficiency.

It is also known to control reheat steam temperature by the use of gas recirculation. In this method large quantities of flue gases are recirculated to achieve the rated reheater outlet steam temperature. A drawback of this method is that it requires use of a gas recirculation fan for handling a hot dust laden gas and requires additional power consumption.

Finally, it is known to control reheat temperature by dividing the reheat steam flow using a steam bypass to divide or alter steam flow into the reheater, as set forth in U.S. Pat. No. 5,038,568. Inherent in this method is interference with reheat steam flow with resulting negative effect on reheat steam pressure loss and cycle efficiency.

What is needed therefore is a method and system for controlling reheater steam temperature which does not have the deficiencies and drawbacks of known methods and systems, and which in particular does not require any adjustment, alteration or interference with reheater steam flow. Additionally, a method and system for controlling reheat steam temperature with minimal reheater pressure loss and without reheater spray attemperation is needed.

SUMMARY

The present invention meets these needs and provides a method and system for accurately, precisely and economically controlling reheater steam temperature without use of gas bypass, external heat exchanger, water spray of reheat steam, excess air, gas recirculation or any adjustment, alteration or interference with reheater steam flow.

A method for controlling reheater steam temperature according to the present invention can be carried out by first providing a convection pass comprising a primary reheater section, a secondary reheater section upstream of the primary reheater section relative to the direction of flow of the combustion gas in the convection pass, and a non-reheater heat exchanger. A second step in the method is to position the non-reheater heat exchanger between the primary and secondary reheater sections. The final step can be to selectively adjust the flow of the fluid through the non-reheater heat exchanger, thereby controlling reheater steam temperature.

The non-reheater heat exchanger is a superheater and the fluid flowing through the non-reheater heat exchanger is preferably superheated steam. Additionally, the fluid can flow through the non-reheater heat exchanger in a direction parallel to the combustion gas flow.

The method can include the further step of positioning a second non-reheater heat exchanger outside the convection pass and directing the fluid from the non-reheater heat exchanger through the second non-reheater heat exchanger.

Preferably, the second non-reheater heat exchanger is a secondary superheater.

The temperature of the fluid entering either the non-reheater heat exchanger and/or the secondary superheater section can be adjusted by water spray.

A more detailed embodiment of a method for controlling reheater steam temperature can include the steps of: providing a convection pass comprising a primary reheater section, a secondary reheater section upstream of the primary reheater section relative to the direction of flow of the combustion gas in the convection pass, and a superheater; positioning the superheater between the two reheater sections; selectively adjusting the flow of the fluid through the superheater, and in response to the selective adjustment controlling reheater steam temperature; directing the fluid through the superheater in a direction parallel to a combustion gas flow; positioning a second superheater section outside the convection pass which comprises the primary and secondary reheater sections; directing the fluid from the superheater through a secondary superheater; and adjusting a temperature of the fluid entering either the superheater and/or the secondary section by water spray.

A method within the scope of the present invention for adjusting a temperature of a fluid in a reheater of a circulating fluidized bed power plant can have the steps of: conducting a fluid through a first reheater comprising a tube capable of conducting steam; conducting the fluid through a second reheater comprising a tube capable of conducting steam, wherein the first and second reheater tubes are connected, and the fluid flows through the first reheater tube and then through the second reheater tube; permitting a second fluid to flow through a non-reheater heat exchanger, wherein the non-reheater heat exchanger comprises a tube capable of conducting steam, and the heat exchanger is located between the first and second reheaters, wherein the second fluid is primary steam and upon exiting the non-reheater heat exchanger is directed to a secondary superheater and eventually to a high pressure turbine system; passing a combustion gas sequentially over an exterior surface of the second reheater tube, the non-reheater heat exchanger tube, and then over an exterior surface of the first reheater tube, wherein the combustion gas is generated by combustion of a carbonaceous fuel in a circulating fluidized bed; adjusting the flow of the second fluid into the heat non-reheater heat exchanger tube, thereby adjusting the temperature of the fluid in the first reheater tube; and passing the fluid exiting the second reheater to an intermediate or low pressure turbine system.

The present invention also encompasses a system, such as a fluid heating system having: a convection pass through which hot combustion gases can pass; a primary reheater section disposed in the convection pass; a secondary reheater section disposed in the convection pass in a position upstream of and spaced apart from the primary reheater with respect to the direction of gas flow in the convection pass; a non-reheater heat exchanger disposed in the convection pass between the primary and secondary reheater sections; means for circulating superheated steam through the non-reheater heat exchanger with the heat absorbed by the heat exchanger from the combustion gases varying with the rate of flow of the superheated steam through the non-reheater heat exchanger; means for controlling the flow of superheated steam through the non-reheater heat exchanger; and means for regulating the means for controlling.

In this system the means for controlling can include a bypass conduit so connected as to divert part of the superheated steam around the non-reheater heat exchanger. Additionally, the means for regulating can comprise device for sensing changes in the secondary reheater outlet temperature, whereby in response to a reheater temperature increase the superheated steam flow through the non-reheater heat exchanger is increased, and in response to a reheater temperature decrease the superheated steam flow through the non-reheater heat exchanger is decreased, so that the means for regulating is capable of maintaining a predetermined secondary reheater section outlet temperature.

Finally, the present invention includes within its scope a circulating fluidized bed power plant. Such a power plant can have: a combustor for burning a solid, particulate carbonaceous fuel, such as a fossil fuel, in a circulating fluidized bed and generating combustion gases; a convection pass through which the combustion gases can pass; a primary reheater section disposed in the convection pass; a secondary reheater section disposed in the convection pass in a position upstream of and spaced apart from the primary reheater with respect to the direction of gas flow in the convection pass; a non-reheater heat exchanger disposed in the convection pass between the primary and secondary reheater sections; means for circulating superheated steam through the non-reheater heat exchanger with the heat absorbed by the heat exchanger from the combustion gases varying with the rate of flow of the superheated steam through the non-reheater heat exchanger; means for controlling the flow of superheated steam through the non-reheater heat exchanger, wherein the means for controlling comprises a bypass conduit so connected as to divert part of the superheated steam around the non-reheater heat exchanger; and means for regulating the means for controlling, wherein the means for regulating comprises a device for sensing changes in the secondary reheater outlet temperature, whereby in response to a reheater temperature increase the superheated steam flow through the non-reheater heat exchanger is increased, and in response to a reheater temperature decrease the superheated steam flow through the non-reheater heat exchanger is decreased, so that the means for regulating is capable of maintaining a predetermined secondary reheater section outlet temperature.

DRAWINGS

These and other features, aspects, and advantages of the present invention can become better understood from the following description, claims and the accompanying drawings where:

FIG. 1 illustrates a convection pass with heat exchangers and reheat steam control means.

DESCRIPTION

Figure 1:
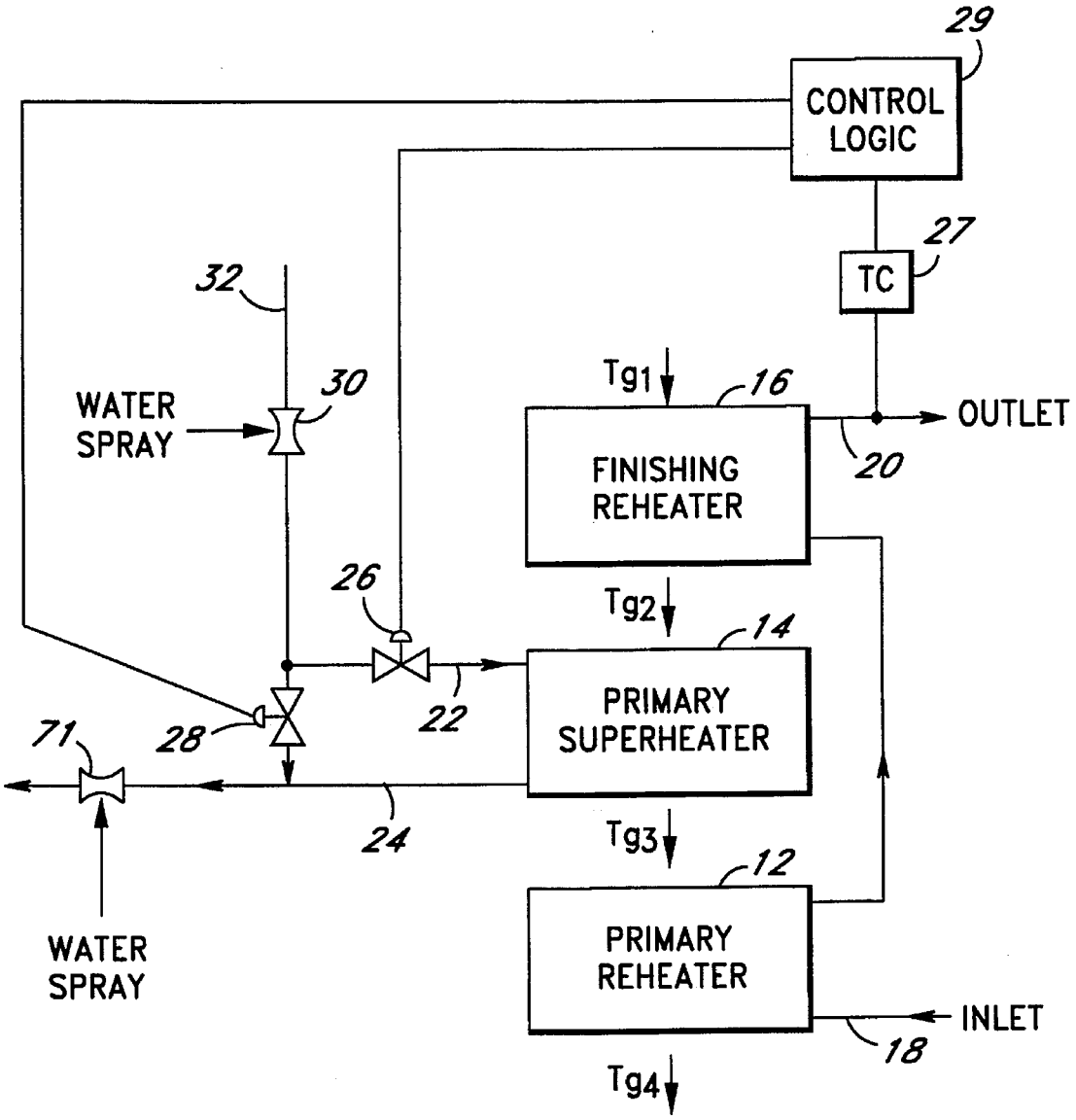
FIG. 1 is a schematic diagram of a system within the scope of the present invention. Thus.

The present invention is based upon the discovery that reheater steam temperature can be controlled by selectively adjusting the flow of a fluid into a non-reheater heat exchanger disposed in a convection pass between two reheater sections.

We have found that a high reheater steam temperature can be lowered by increasing the flow of steam in a superheater interposed between two reheater sections. Increasing the flow of superheated steam lowers the temperature of the steam passing through the superheater. This in turn, increases the amount of heat absorbed by the superheater from the combustion gases flowing over the superheater. Thus, less heat is available for the reheater section downstream of the superheater to absorb from the combustion gases, resulting therefore in a lowered reheat steam temperature.

Conversely, we have found that a low reheater steam temperature can be increased by decreasing the flow of superheated steam in a superheater. This increases the temperature of the steam passing through the superheater. Increasing the temperature of the superheater steam decreases the amount of heat absorbed by the superheater from the combustion gases. Hence, more heat is available for the reheater section downstream of the superheater to absorb from the combustion gases, resulting in an increased reheat steam temperature.

A system according to the present invention has a superheater positioned between a finishing or second reheater and a primary or first reheater. A desired goal is to reduce the amount of heat transfer occurring in the superheater to allow more heat to be available in the combustion gas for the primary reheater to absorb. As stated, heat transfer in the superheater is reduced by causing the temperature of the fluid in the superheater to increase. The temperature of the fluid in the superheater is increased by bypassing some of the primary steam around the superheater.

Thus, an important objective of the present invention is to reduce the heat transfer occurring in the non-reheater heat exchanger to allow more heat to be available in the combustion gas for a primary reheater to absorb. Heat transfer in a non-reheater heat exchanger positioned between two reheater sections can be reduced by causing the temperature of a fluid in the non-reheater heat exchanger to increase.

Specifically, adjustment of an interposed non-reheater heat exchanger fluid temperature is carried out bypassing some of the primary steam around the non-reheater heat exchanger.

Notably, reheat steam temperature control is not carried out by mixing hot steam with cooler feedwater, as such an approach can degrade cycle efficiency and cause maintenance problems.

Additionally, it is undesirable to use water as the fluid in the non-reheater heat exchanger. Thus, decreasing a water flow through the non-reheater heat exchanger can cause the water to become hotter until it reaches the boiling point. As the flow rate is decreased further, the water stays at the boiling temperature until it reaches a superheat temperature. For the entire range of flow rates beginning at incipient boiling to incipient superheat, there is no significant change in heat absorption by the non-reheater heat exchanger. This can result in controllability problems. Additionally, having feedwater enter and superheated steam exit the non-reheater heat exchanger, there is a potential for internal fouling of the non-reheater heat exchanger tubing. Furthermore, flow problems can be introduced at the point at which steam bypassed around the non-reheater heat exchanger water and steam leaving the non-reheater heat exchanger are recombined. All of these problems can be avoided by using superheated steam instead of water as the inlet fluid into the non-reheater heat exchanger positioned between two reheater sections in a convection pass.

Importantly, the overall or net flow direction of the superheated steam in the non-reheater heat exchanger is very preferably parallel, as opposed to counterflow, in relation to the combustion gas flow direction, because parallel flow results in a lesser absorption of heat by the non-reheater heat exchanger. Additionally, a parallel flow of superheated steam in relation to the combustion gas results in superior process controllability. Thus, the non-reheater heat exchanger tube bundles are preferably positioned horizontally in the convection pass and perpendicular to the combustion gas flow. Parallel flow is achieved by having a fluid entering the non-reheater heat exchanger at an upstream inlet, and exiting the non-reheater heat exchanger at a downstream location in relation to the direction of combustion gas flow.

Thus, steam bypass is used to control reheat steam temperature. Superheated steam temperature can be controlled by spray attemperation. Spray attemperation is not used on reheat steam because it can negatively affect cycle efficiency.

Referring to FIG. 1, an embodiment of the present invention includes a primary or first reheater 12, a superheater 14, and a secondary or finishing reheater 16. Superheater 14 can be either a primary or an intermediate superheater. Reheater 12, superheater 14, and reheater 16 comprises closely spaced steam-filled tube bundles. Primary reheater 12 has a fluid inlet 18, which inlet can lead from a high pressure turbine system. Secondary reheater 16 has a fluid outlet 20, which outlet can lead to an intermediate or low pressure turbine system.

Primary superheater 14 has a fluid inlet line 22 and a fluid outlet line 24. Fluid inlet line 22 can proceed from a steam drum or from superheat assemblies downstream of the stream drum, and carries primary steam. Superheater outlet line 24 can, through one or more additional superheater sections, carry superheated steam to a high pressure turbine system. As shown by the location of the inlet line 22 and the outlet line 24, although the superheater 14 tube bundles are positioned horizontally in the convection pass and perpendicular to the combustion gas flow, the net steam flow direction is the same as the combustion gas flow direction. Thus, the superheated steam flows in superheater 14 in a direction parallel to the combustion gas flow through the convection pass. A counterflow through superheater 14 would considerably reduce the effectiveness and desired effect of the present invention for controlling reheat steam temperature.

Control valves 26 and 28 provide a means for bypassing primary steam around superheater 14. Valve 26 can be used to control the flow of steam into superheater 14, while valve 28 controls the flow of steam bypassing superheater 14. Valves 26 and 28 can be operated automatically in response to a signal derived from a temperature measurement of the final reheat steam by thermocouple ("TC") 27. For example, if reheat steam temperature (as determined by thermocouple 27) is too high, then more heat needs to be absorbed by superheater 14, so control logic 29 responds by opening valve 26 further and closing valve 28 further. Water spray can be accomplished through inlet means 30.

Combustion gas in the convection pass flows over the surface of the secondary reheater 16 at a temperature $T_{g1}$. Heat exchange by the tube bundles of secondary reheater 16 results in a lower temperature $T_{g2}$ combustion gas entering the tube bundles of the non-reheater heat exchanger 14.

Increasing the temperature of the fluid in non-reheater heat exchanger 14 by the method of the present invention can result in only a small temperature drop of the combustion gas from $T_{g2}$ to $T_{g3}$. In this manner, heat exchange by primary reheater 12 is maximized as the combustion gas temperature experiences a relatively greater decrease to $T_{g4}$.

The temperature of reheat steam in outlet 20 can be controlled by passing primary steam in line 32 or by water spraying at inlet 30. In this manner the gas temperature $T_{g3}$, entering the first steam reheat bank 12 can be selectively adjusted. This permits the amount of heat absorbed by the first reheat bank 12 to be adjusted and, significantly, this is accomplished without interfering with or altering the steam flow into either of the reheater sections 12 and 16.

Figure 2:
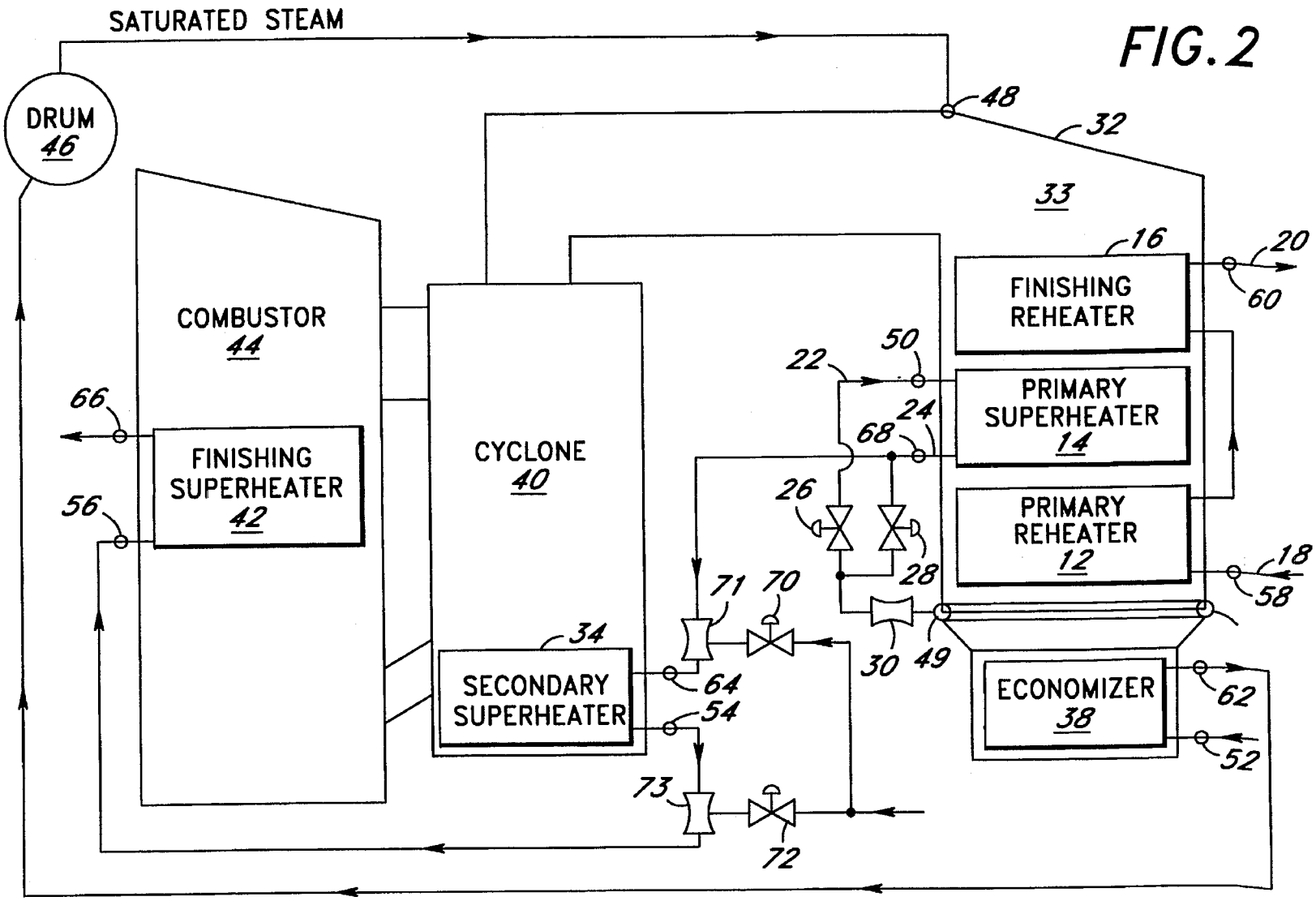
FIG. 2 is schematic diagram illustrating a boiler system embodying aspects of the present invention.

FIG. 2 illustrates an embodiment of the present invention in the context of a steam drum boiler with additional heat exchanger sections. Water attemperation of steam into secondary superheater 34 can be carried out through use of water spray station 71 and valve 70. Water attemperation of steam into finishing superheater 42 can be carried out through use of water spray station 73 and valve 72. An economizer 38 can be located downstream of the primary reheater 12. A system within the scope of the present invention an also include a cyclone particle separator 40, a finishing superheater 42 located in the radiant heating area of the furnace or combustor 44 and a steam drum 46, all with attendant inlet and outlet lines. Saturated steam flows out of steam drum 46 into line 32 on the perimeter of a steam cooled enclosure of convection pass 33.

Inlet headers are located at 48, 50, 52, 54, 56 and 58. Outlet headers are located at 49, 60, 62, 64, 66 and 68. Header 48 supplies steam to line 32. Rectangular outlet header 49 is an outlet header from the steam cooled enclosure 33. From header 49, steam passes either through valve 28 to bypass superheater 14, or through valve 26 to enter header 50, which is the inlet header for superheater 14. Superheater 14 discharges through tube or line 24 into outlet header 68.

After the steam from valve 28 and header 68 are recombined, it passes through spray station 71 to inlet header 64 of the secondary superheater 34. Spray 71 is provided in the event that the steam temperature in secondary superheater 34 approaches allowable limits. Steam from secondary superheater 34 discharges into outlet header 54. The steam then passes through another spray station 73 which performs final superheater 42 control based upon a temperature measurement performed at header 66.

The steam then passes to inlet header 56 of finishing superheater 42, and discharges into the outlet header 66 of superheater 42.

Within the scope of the present invention is a system without superheater 42, header 56, header 66, and spray station 66. In such an alternate embodiment of the invention, superheater 34 would be the finishing superheater, and valve 72 would not be required.

Economizer 38 receives water from its inlet header 52, and discharges its water into outlet header 62. Water from the economizer is transferred into the steam drum 46.

Steam from the high pressure turbine passes via line 18 to the inlet header 58 for the primary reheater 12. The steam then passes to the finishing superheater 16 and discharges into the outlet header 60.

Valves 70 and 72 serve to divide the superheater spray flow between spray stations 71 and 73 as follows: total spray flow through spray stations 71 and 73 is determined based upon final superheat temperature at header 66, while flow to spray station 71 is the minimum necessary to ensure that allowable metal temperatures in superheater 34 are not exceeded.

EXAMPLES

A sample system was used to demonstrate the performance of the disclosed invention. The sample system included, as shown by FIG. 1, a primary superheater between a finishing reheater and a primary reheater. Heat transfer calculations carried out upon data obtained from operation of the sample system resulted in FIGS. 3 and 4.

Figure 3:
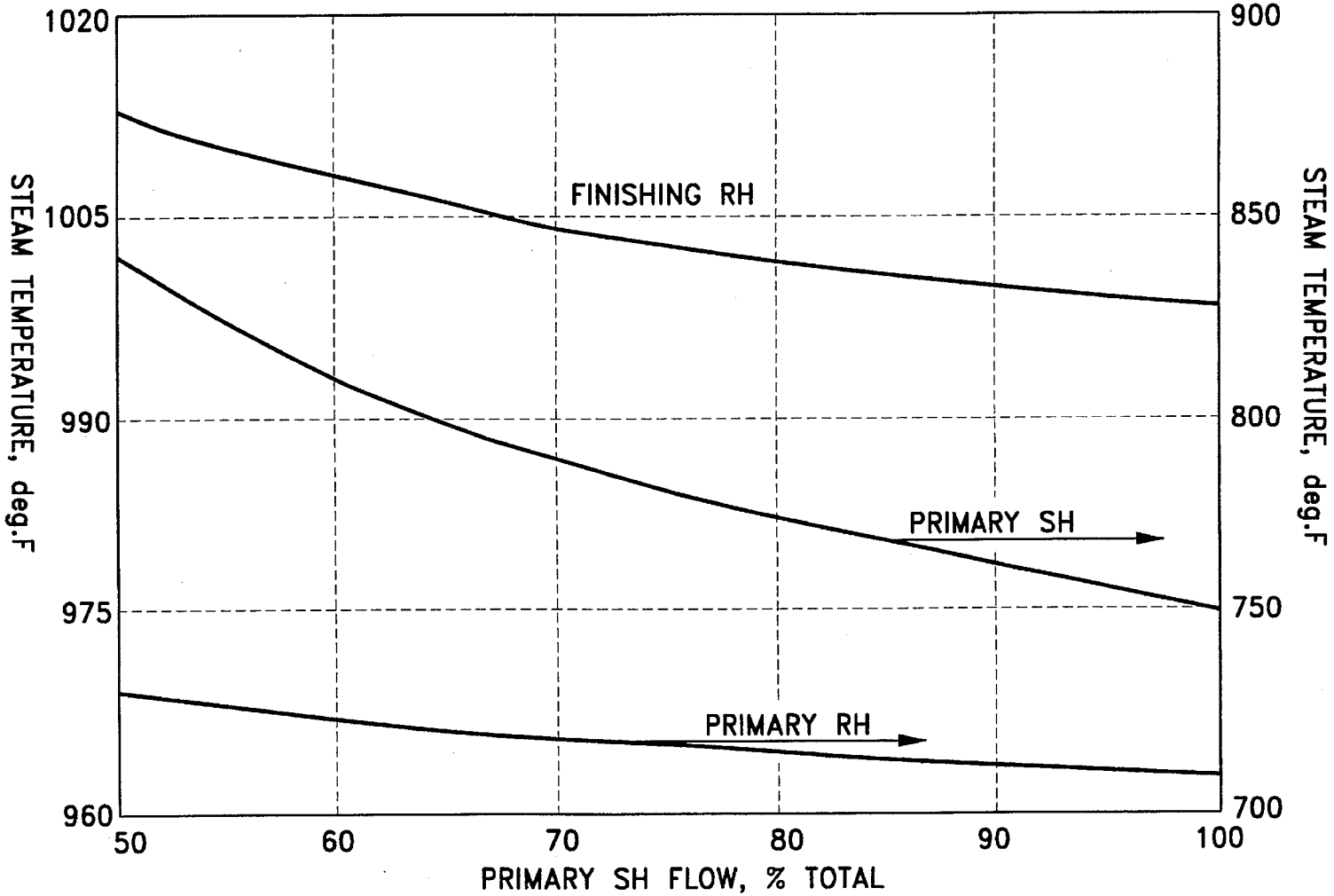
FIG. 3 is a graphical representation of steam temperature versus primary superheater steam flow for a system embodying the disclosed invention.

FIG. 3 shows the steam temperature leaving each of the finishing reheater (left hand side vertical axis), the primary (non-reheat) superheater (right hand side vertical axis), and the primary reheater tube bundles (right hand side vertical axis), plotted as a function of the percentage of total steam flow passing through the primary superheater (horizontal axis). FIG. 3 shows that as the flow rate through the primary superheater decreases, the temperature of the steam leaving the primary superheater increases. As the flow rate in the primary superheater decrease, the heat transfer in the primary superheater decreases as well, as shown best by FIG. 4.

Figure 4:
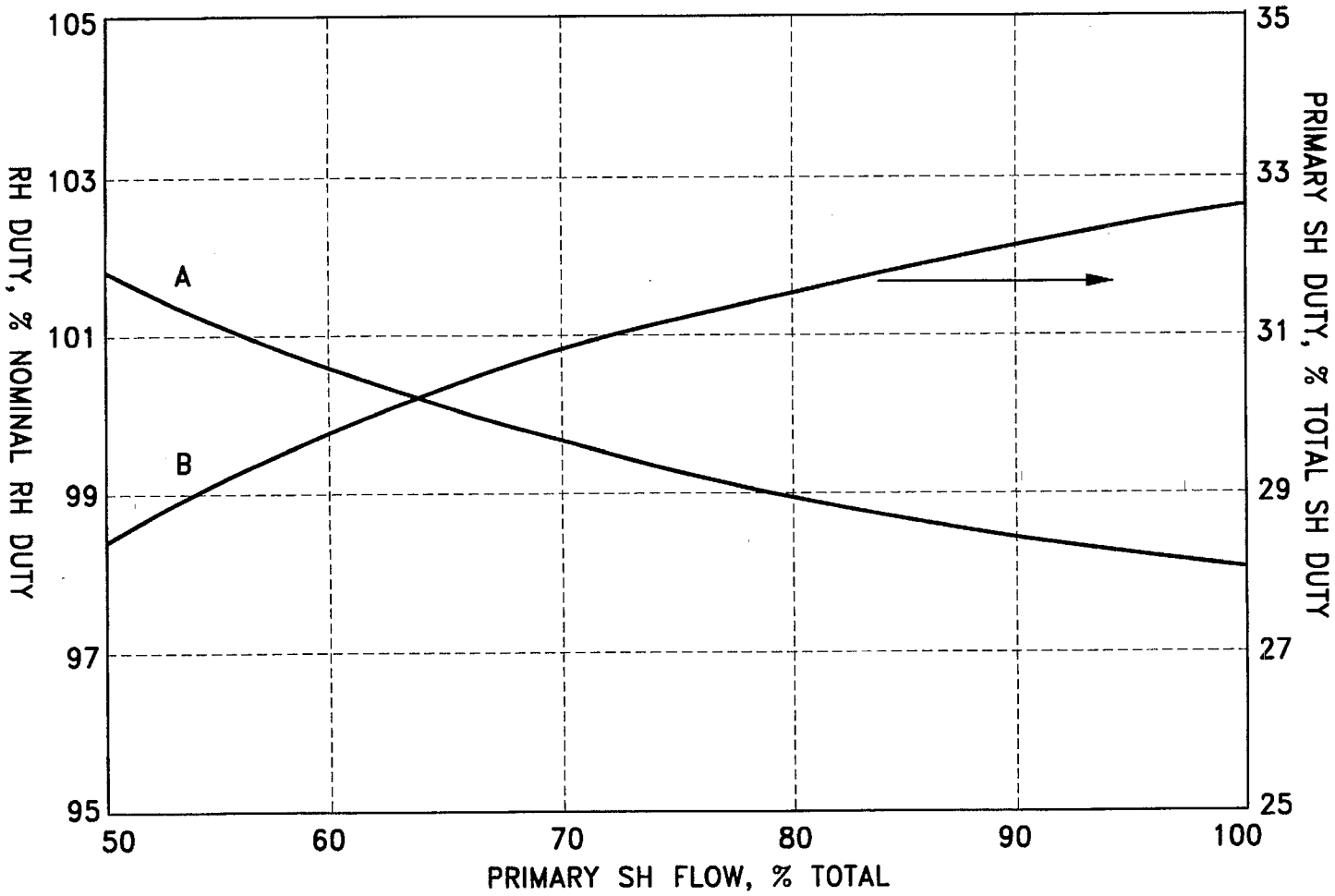
FIG. 4 is a graphical representation of primary reheater and primary superheater heat duty versus steam flow through the primary superheater for the system of FIG. 3.

FIG. 4 shows heat transfer accomplished by the primary reheater (curve A) and the primary superheater (curve B) as a function of the steam flow through the primary superheater for the sample system used. The left hand side vertical axis of FIG. 4 represents the level of heat transfer to the primary reheater. The right hand side vertical axis of FIG. 4 represents the level of heat transfer to the primary superheater.

FIG. 4 clearly shows that as steam flow in the primary superheater (horizontal axis) is decreased, heat transfer to the primary reheater is increased.

A method and system according to the present invention for controlling reheat steam temperature has many advantages, including the following:

1. The method and system can be used for a circulating fluidizing bed unit as well as for all other reheat type units.
2. Eliminates the need for a backpass with a divided gas stream, thereby reducing cost and improving availability.
3. Eliminates the need for excess air and flue gas recirculation at reduced operating cost.
4. Reheat steam temperature is controlled by having two reheater sections separated by a non-reheater heat exchanger, within which the heat absorbed from the combustion gas is adjusted by varying the flow rate of the fluid in the non-reheater heat exchanger. Preferably, the fluid in the non-reheater heat exchanger is superheated steam.
5. Superheated steam in the non-reheater heat exchanger flows parallel with respect to the gas flow direction.
6. A finishing superheater can be located at a point in the boiler system outside the convection or gas pass in which the reheater sections are located.

Although the present invention has been described in detail with regard to certain preferred methods, other embodiments, versions, and modifications within the scope of the present invention are possible. For example, a wide variety of boiler configurations encompassing the elements of the invention set forth by FIG. 1 are possible.

Accordingly, the spirit and scope of the following claims should not be limited to the descriptions of the preferred embodiments set forth above.

We claim:

1. A method for controlling reheater steam temperature, comprising the steps of:

(a) providing a convection pass comprising a primary reheater section, a secondary reheater section upstream of the primary reheater section relative to a direction of flow of a combustion gas in the convection pass, and a non-reheater heat exchanger;

(b) positioning the non-reheater heat exchanger between the primary and secondary reheater sections; and (c) positioning a second non-reheater heat exchanger outside the convection pass;

(d) selectively adjusting a flow of a fluid through the non-reheater heat exchanger, and in response to the selective adjustment controlling reheater steam temperature.

2. The method of claim 1, wherein the non-reheater heat exchanger is a superheater.

3. The method of claim 1, wherein the fluid flowing through the non-reheater heat exchanger is steam.

4. The method of claim 1, wherein the fluid flows through the non-reheater heat exchanger in a direction parallel to the combustion gas flow.

5. The method of claim 1, further comprising the step of directing the fluid from the non-reheater heat exchanger through the second non-reheater heat exchanger.

6. The method of claim 5, wherein the second non-reheater heat exchanger is a secondary superheater.

7. The method of claim 6, wherein the temperature of the fluid entering either the non-reheater heat exchanger and/or the secondary superheater section is adjusted by water spray.

8. A method for controlling reheater steam temperature, comprising the steps of:

(a) providing a convection pass comprising a primary reheater section, a secondary reheater section upstream of the primary reheater section relative to a direction of flow of a combustion gas in the convection pass, and a superheater;

(b) positioning the superheater between the two reheater sections;

(c) selectively adjusting a flow of a fluid through the superheater, and in response to the selective adjustment controlling reheater steam temperature;

(d) directing the fluid through the superheater in a direction parallel to a combustion gas flow;

(e) positioning a second superheater section outside the convection pass which comprises the primary and secondary reheater sections;

(f) directing the fluid from the superheater through a secondary superheater; and (g) adjusting a temperature of the fluid entering either the superheater and/or the secondary section by water spray.

9. A method for adjusting a temperature of a fluid in a reheater of a circulating fluidized bed power plant, comprising the steps of:

(a) conducting a fluid through a first reheater comprising a tube capable of conducting steam;

(b) conducting the fluid through a second reheater comprising a tube capable of conducting steam, wherein the first and second reheater tubes are connected, and the fluid flows through the first reheater tube and then through the second reheater tube;

(c) permitting a second fluid to flow through a non-reheater heat exchanger, wherein the non-reheater heat exchanger comprises a tube capable of conducting steam, and the heat exchanger is located between the first and second reheaters, wherein the second fluid is steam and upon exiting the non-reheater heat exchanger is directed to secondary superheater and then to a high pressure turbine system;

(d) passing a combustion gas sequentially over an exterior surface of the second reheater tube, the non-reheater heat exchanger tube, and then over an exterior surface of the first reheater tube, wherein the combustion gas is generated by combustion of a carbonaceous fuel in a circulating fluidized bed;

(e) adjusting the flow of the second fluid into the non-reheater heat exchanger tube, thereby adjusting the temperature of the fluid in the first reheater tube; and (f) passing the fluid exiting the second reheater to an intermediate or low pressure turbine system.

10. The method of claim 9, wherein the second fluid is superheated steam.

11. The method of claim 9, wherein the second fluid flows in the non-reheater heat exchanger tube in a direction parallel to the combustion gas flow.

12. The method of claim 9, wherein the non-reheater heat exchanger is a superheater.

13. A fluid heating system, comprising:

(a) a convection pass through which hot combustion gases can flow;

(b) a primary reheater section disposed in the convection pass;

(c) a secondary reheater section disposed in the convection pass in a position upstream of and spaced apart from the primary reheater with respect to the direction of gas flow in the convection pass;

(d) a non-reheater heat exchanger disposed in the convection pass between the primary and secondary reheater sections;

(e) means for admitting superheated steam into the non-reheater heat exchanger with the heat absorbed by the heat exchanger from the combustion gases varying with the rate of flow of the superheated steam through the non-reheater heat exchanger;

(f) means for controlling the flow of superheated steam through the non-reheater heat exchanger; and (g) means for regulating the means for controlling, wherein the means for regulating comprises a device for sensing changes in the secondary reheater outlet temperature, whereby in response to a reheater temperature increase the superheated steam flow through the non-reheater heat exchanger is increased, and in response to a reheater temperature decrease the superheated steam flow through the non-reheater heat exchanger is decreased, so that the means for regulating is capable of maintaining a predetermined secondary reheater section outlet temperature.

14. The system of claim 13, wherein the means for controlling comprises a bypass conduit so connected as to divert part of the superheated steam around the non-reheater heat exchanger.

15. A circulating fluidized bed power plant, comprising (a) a combustor for burning a solid, particulate carbonaceous fuel in a circulating fluidized bed and generating combustion gases;

(a) a convection pass through which the combustion gases flow;

(b) a primary reheater section disposed in the convection pass;

(c) a secondary reheater section disposed in the convection pass in a position upstream of and spaced apart from the primary reheater with respect to the direction of gas flow in the convection pass;

(d) a non-reheater heat exchanger disposed in the convection pass between the primary and secondary reheater sections;

(d) means for admitting superheated steam into the non-reheater heat exchanger with the heat absorbed by the heat exchanger from the combustion gases varying with the rate of flow of the superheated steam through the non-reheater heat exchanger;

(e) means for controlling the flow of superheated steam through the non-reheater heat exchanger, wherein the means for controlling comprises a bypass conduit so connected as to divert part of the superheated steam around the non-reheater heat exchanger; and (f) means for regulating the means for controlling, wherein the means for regulating comprises a device for sensing changes in the secondary reheater outlet temperature, whereby in response to a reheater temperature increase the superheated steam flow through the non-reheater heat exchanger in increased, and in response to a reheater temperature decrease the superheated steam flow through the non-reheater heat exchanger in decreased, so that the means for regulating is capable of maintaining a predetermined secondary reheater section outlet temperature.

* * * * *